US007600608B2

(12) United States Patent
Freiheit

(10) Patent No.: US 7,600,608 B2
(45) Date of Patent: Oct. 13, 2009

(54) ACTIVE ACOUSTICS PERFORMANCE SHELL

(75) Inventor: Ronald R. Freiheit, Owatonna, MN (US)

(73) Assignee: Wenger Corporation, Owatonna, MN (US)

( * ) Notice: Subject to any disclaimer, the term of this patent is extended or adjusted under 35 U.S.C. 154(b) by 195 days.

(21) Appl. No.: 11/229,058

(22) Filed: Sep. 16, 2005

(65) Prior Publication Data

US 2006/0060420 A1 Mar. 23, 2006

Related U.S. Application Data

(60) Provisional application No. 60/610,324, filed on Sep. 16, 2004.

(51) Int. Cl.
*E04B 1/343* (2006.01)
*E04B 1/99* (2006.01)

(52) U.S. Cl. ..... 181/287; 181/30

(58) Field of Classification Search ..... 181/287, 181/30; 381/87, 89, 332, 333, 334, 335, 381/336, 91, 92

See application file for complete search history.

(56) References Cited

U.S. PATENT DOCUMENTS 1,675,102 A * 6/1928 Holland ..... 181/30
3,217,366 A * 11/1965 Wenger ..... 52/6
3,630,309 A 12/1971 Wenger et al.
3,908,787 A * 9/1975 Wenger et al. ..... 181/30
4,061,876 A 12/1977 Jaffe
4,104,835 A * 8/1978 Bardwick, III ..... 52/7
4,227,047 A * 10/1980 Horne ..... 381/300
4,241,777 A 12/1980 Wenger et al.
4,278,145 A 7/1981 Eade et al.
4,330,691 A * 5/1982 Gordon ..... 381/335
4,366,882 A 1/1983 Parker
4,418,243 A 11/1983 Figler
4,515,238 A * 5/1985 Baker ..... 181/30
4,566,557 A * 1/1986 Lemaitre ..... 181/150
D304,083 S 10/1989 Jenne
5,069,011 A 12/1991 Jenne
5,109,419 A 4/1992 Griesinger
5,119,428 A 6/1992 Prinssen
5,123,874 A * 6/1992 White, III ..... 454/251
5,168,129 A * 12/1992 D'Antonio ..... 181/30
5,403,979 A 4/1995 Rogers
5,519,178 A * 5/1996 Ritto et al. ..... 181/199
5,524,691 A 6/1996 Jines
5,525,765 A 6/1996 Freiheit (Continued)

OTHER PUBLICATIONS

Prinssen, Wim and D'Antonio, Peter, *The History of Electronic Architecture And Variable Acoustics*, System For Improved Acoustic Performance, Date unknown, pp. 1-32.

(Continued)

*Primary Examiner*—Jeffrey Donels
*Assistant Examiner*—Forrest M Phillips
(74) *Attorney, Agent, or Firm*—Patterson, Thuente, Skaar & Christensen, P.A.

(57) ABSTRACT

An electroacoustic shell system adapted create a performance area where sound created by a performer is received, processed, and returned to the performer in the performance area. The system broadly includes an electroacoustic shell with a vertical panel and a canopy, a microphone and a speaker operably coupled to the shell, and an electronics processing assembly connected to the microphones and speakers for recording, broadcasting, and simulating sound.

20 Claims, 11 Drawing Sheets

U.S. PATENT DOCUMENTS

| | | | | |
|---|---|---|---|---|
| 5,525,766 | A | 6/1996 | Atcheson et al. | |
| 5,530,211 | A * | 6/1996 | Rogers et al. | 181/30 |
| 5,622,011 | A | 4/1997 | Jines | |
| 5,646,378 | A | 7/1997 | Van Haaff et al. | |
| 5,651,405 | A | 7/1997 | Boeddeker et al. | |
| 5,778,081 | A * | 7/1998 | Patrick | 381/71.5 |
| 5,844,996 | A * | 12/1998 | Enzmann et al. | 381/71.6 |
| 5,875,591 | A | 3/1999 | Jines | |
| 5,901,505 | A | 5/1999 | Dettmann et al. | |
| 6,059,274 | A * | 5/2000 | Owen et al. | 267/136 |
| 6,085,861 | A * | 7/2000 | Jines | 181/30 |
| 6,158,690 | A * | 12/2000 | Wadey et al. | 244/17.27 |
| 6,434,240 | B1 * | 8/2002 | Kulas | 381/89 |
| 6,487,298 | B1 * | 11/2002 | Hacker | 381/363 |
| 6,700,304 | B1 * | 3/2004 | Fuller et al. | 310/321 |
| 6,751,322 | B1 | 6/2004 | Carlbom et al. | |
| 6,896,097 | B2 * | 5/2005 | Nishikawa et al. | 181/199 |
| 7,184,557 | B2 * | 2/2007 | Berson | 381/61 |
| 2003/0047380 | A1 * | 3/2003 | Stuart | 181/206 |
| 2003/0234598 | A1 * | 12/2003 | Fuller et al. | 310/328 |
| 2004/0026162 | A1 * | 2/2004 | Christen | 181/30 |
| 2004/0211310 | A1 * | 10/2004 | Hagiwara et al. | 84/726 |
| 2005/0046584 | A1 * | 3/2005 | Breed | 340/825.72 |
| 2006/0039569 | A1 * | 2/2006 | Antaki | 381/71.1 |
| 2006/0060420 | A1 * | 3/2006 | Freiheit | 181/287 |
| 2006/0065476 | A1 * | 3/2006 | Tasker | 181/155 |
| 2007/0110255 | A1 * | 5/2007 | Barath et al. | 381/71.5 |
| 2007/0140510 | A1 * | 6/2007 | Redmann | 381/97 |

OTHER PUBLICATIONS

Griesinger, *An Audio Engineering Society Preprint*, Dated Feb. 19-22, 1991, pp. 1-15.

Declaration of Larry Mah, pp. 1-4, May 20, 1998, with Exhibits A-C.

Declaration of William Gardiner, pp. 1-3, Jun. 25, 1998.

William Grant Gardner, *The Virtual Acoustic Room* S.B. Computer Science and Engineering, Aug. 10, 1992, pp. 69.

* cited by examiner

ACTIVE ACOUSTICS PERFORMANCE SHELL

RELATED APPLICATION

The present application claims the benefit of U.S. Provisional Application No. 60/610,324 filed Sep. 16, 2004, which is incorporated herein in its entirety by reference.

FIELD OF THE INVENTION

The present invention relates generally to the field of movable or portable acoustic shells for use by performers. More specifically, the present invention relates to a movable or portable acoustic shell including electronically enhanced acoustics to provide performers with a variety of selectable acoustic shell tunings depending upon the type of performance and acoustic characteristics of the surrounding environment.

BACKGROUND OF THE INVENTION

Portable acoustic shells provide many advantages to today's performers. One advantage is that performers can be sure of consistent acoustical characteristics as a show travels from location to location. Another advantage is that portable acoustic shells can be used to provide favorable acoustic traits at sites in which the acoustics are generally regarded as poor. A variety of techniques and designs have been used to create portable acoustic shells, for example U.S. Pat. Nos. 3,630,309; 4,241,777; D304,083; 5,524,691; 5,622,011; 5,651,405; and 5,875,591, all of which are commonly assigned to the assignee of the present invention and are all hereby incorporated by reference in their entirety.

While portable acoustic shells provide many advantages, they suffer acoustically in comparison to specially designed acoustical rooms. In an enclosed room, designers can eliminate any acoustical effects of the surrounding environment, resulting in a more consistent and controlled environment. In addition, electronic acoustic systems can be coupled with the enclosed room to emulate any number of acoustical venues to provide more realistic practice and rehearsal conditions. An example of such a system is disclosed in U.S. Pat. No. 5,525,765, commonly assigned to the assignee of the present invention, and hereby incorporated by reference in its entirety.

While portable acoustic shells provide many advantages, it would be desirable to have a portable acoustic shell that provided the type of acoustic flexibility that is available with an enclosed room.

SUMMARY OF THE INVENTION

The portable acoustic shell of the present invention overcomes the acoustical limitations associated with currently available portable acoustic shells. By integrating an electrical acoustic system with a portable acoustic shell, an active sound field can be created that encompasses the performers on stage. The active sound field can be tuned through the placement of speakers throughout the shell structure. By tuning the active sound field, both performers and audience members alike can experience the benefit of a portable acoustic shell that is capable of multiple tuning conditions such that it can be adapted for use by groups with differing numbers of performers, as well as in environments that are not acoustically advantageous.

The active acoustics shell utilizes a moveable (or portable) acoustics shell, which integrates acoustics technology into the shell to provide electronically enhanced acoustics to the performers on stage and to some extent the audience. The benefit of an active acoustics shell is the ability to "tune" the acoustics characteristics of the shell electronically thus allowing various "tunings" depending on the type of music performance being given. Since these are easily changed, multiple tunings could occur during the same event depending on the desires of the groups using the shell. This also allows for a fairly consistent acoustic environment for the musicians to play in, especially when faced with performance spaces that are not conducive to good performance acoustics.

The basic design premise is to create an active sound field from the shells that encompass the performers on the stage. Typically this is done with speakers that are attached to the shell structure. It may also include the addition of speakers located in the overhead reflectors. There is also the need to capture the sound of the performers for processing which is typically (but not restricted to) mounting microphones in the canopy portion of the shells (or could be located in the reflective ceilings above the stage). The sound is captured via the microphones, is equalized based on the transfer function of the shell/stage acoustics (and to some extent the impact of the auditorium area), processed with the acoustics technology and then fed back to the performers on stage via speakers in the shells (and/or overhead reflectors).

In one aspect, the present invention relates to a portable acoustic shell including an electronic acoustical system capable of tuning and projecting an active sound field encompassing performers on stage. Typically, the portable acoustic shell comprises a plurality of vertical panel assemblies placed and attached in proximity with one another to define a performance area. The portable acoustic shell may include an overhead canopy structure to partially enclose the area above the performance area. An electronic acoustic system comprises a microphone assembly, an electronic processing assembly and a speaker assembly. The microphone assembly comprises at least one and preferably, a plurality of microphones positioned above the performance area, often in the canopy, to capture the sound generated by the performers. The electronic processing assembly receives the sounds captured by the microphone assembly and processes the sounds based upon the desired tuning characteristics. The processed sounds are then fed back to the performance area and transmitted through the speaker assembly located within the shell structure resulting in the performers and audience members hearing the tuned version of the performance.

In another aspect, the present invention relates to a method for tuning sounds generated by a performance within a portable acoustical shell. Generally, desired tuning characteristics are inputted into an electronic acoustical system based upon the type and size of a performance, as well as the acoustical characteristics of the surrounding environment. Actual performance sounds are captured by a microphone assembly and are subsequently transmitted to the electronic acoustical system. The electronic acoustical system processes the sounds based on the previously established tuning characteristics. The tuned sounds are retransmitted and broadcast back to the performance area through a speaker assembly located within the acoustic shell structure.

DETAILED DESCRIPTION OF THE PREFERRED EMBODIMENTS

Figure 1:
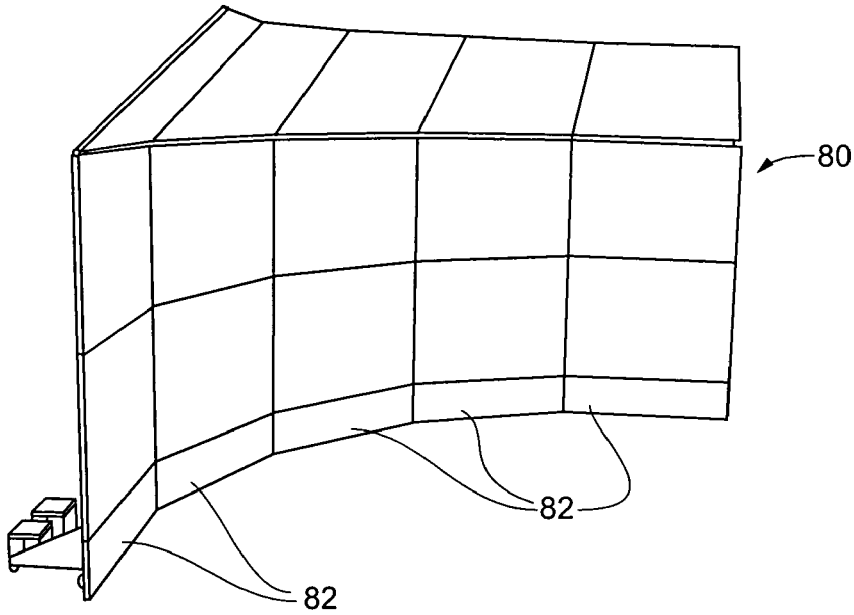
Fig. 1 PRIOR ART
FIG. 1 is a perspective view of a prior art portable acoustic shell.
Figure 2:
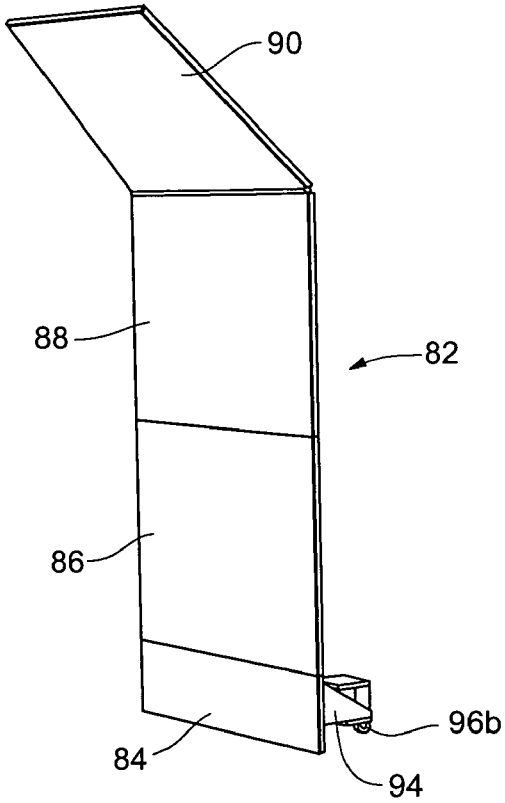
Fig. 2 PRIOR ART
FIG. 2 is a perspective view of a prior art vertical panel assembly.
Figure 3:
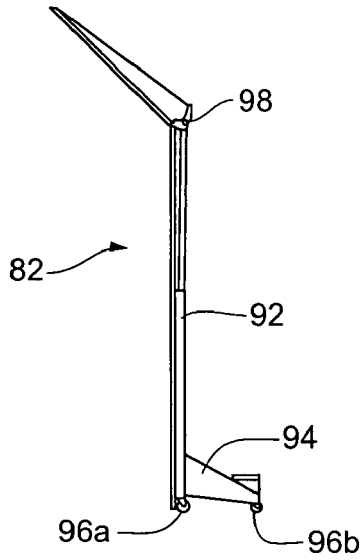
Fig. 3 PRIOR ART
FIG. 3 is a side view of the vertical panel assembly of FIG. 2.

Depicted in FIGS. 1-3 is an acoustic shell 80 of the type commonly known and used by those of skill in the art, such as Wenger® Corporation's Legacy™ Acoustical Shell. Generally, acoustic shell 80 is comprised of a plurality of vertical panel assemblies 82 comprising a plurality of vertical panels; for instance, a kicker panel 84, a lower panel 86, an upper panel 88 and a canopy panel 90, mounted to a vertical frame 92, which is fixedly attached to base assembly 94. Base assembly 94 is typically sized to provide stability to the vertical panel assembly 82. Base assembly 94 typically includes a pair of caster assemblies 96*a*, 96*b* to allow for easy positioning and transport of the vertical panel assembly 82. Between the panel sections, for example, between upper panel 88 and canopy panel 90, vertical frame 92 can include a hinge assembly 98 to allow for rotatable positioning of the canopy panel 90 in comparison to upper panel 88, as well as to allow for fold-up and storage of the vertical panel assembly 82. The panel sections are typically comprised of a composite material to provide a stiff, acoustically reflective surface, while the vertical frame 92 and base assembly 94 are constructed of steel and aluminum for durability and strength.

Figure 4:
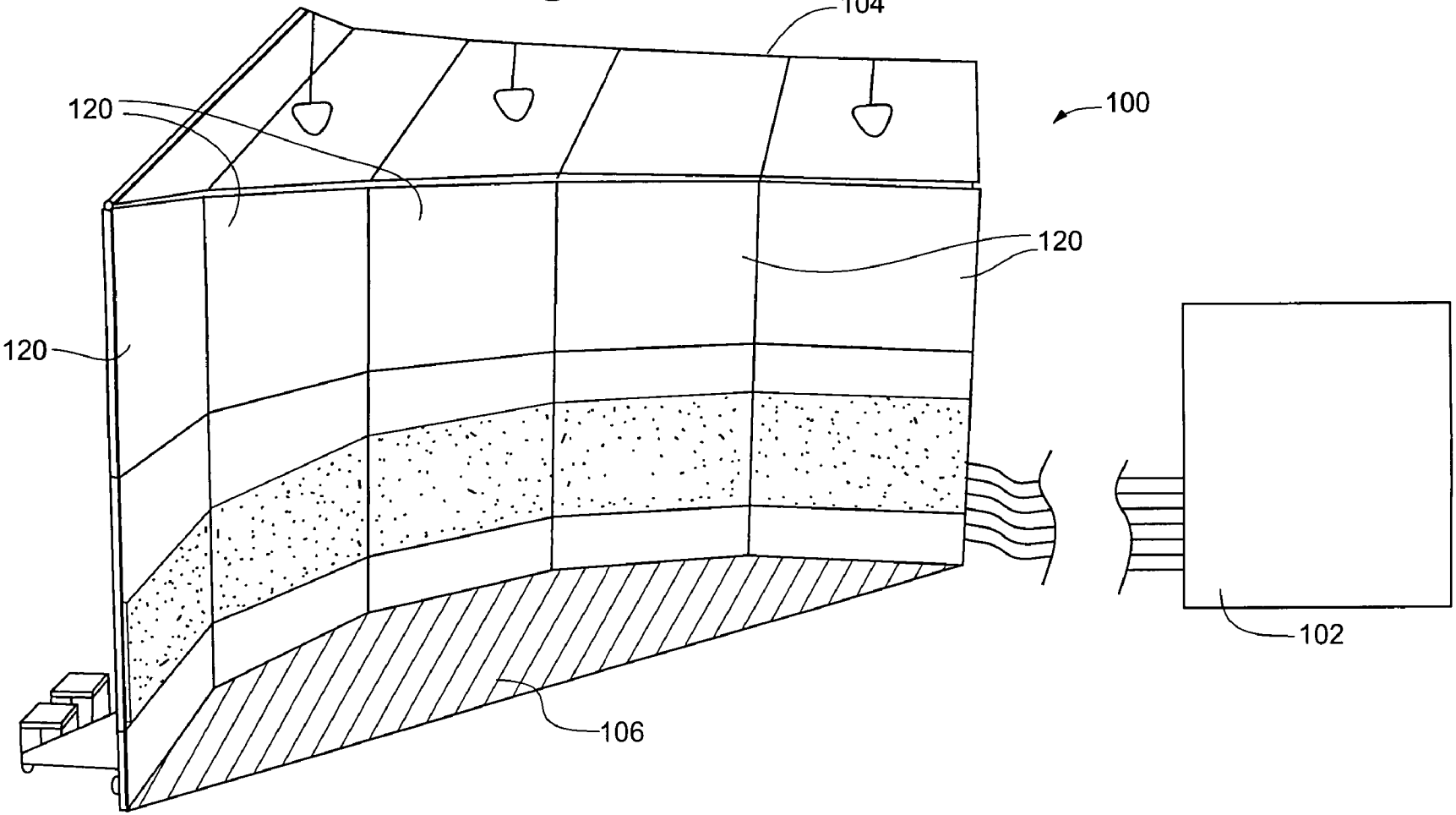
FIG. 4 is a perspective view of a portable acoustic shell system of the present invention.
Figure 5:
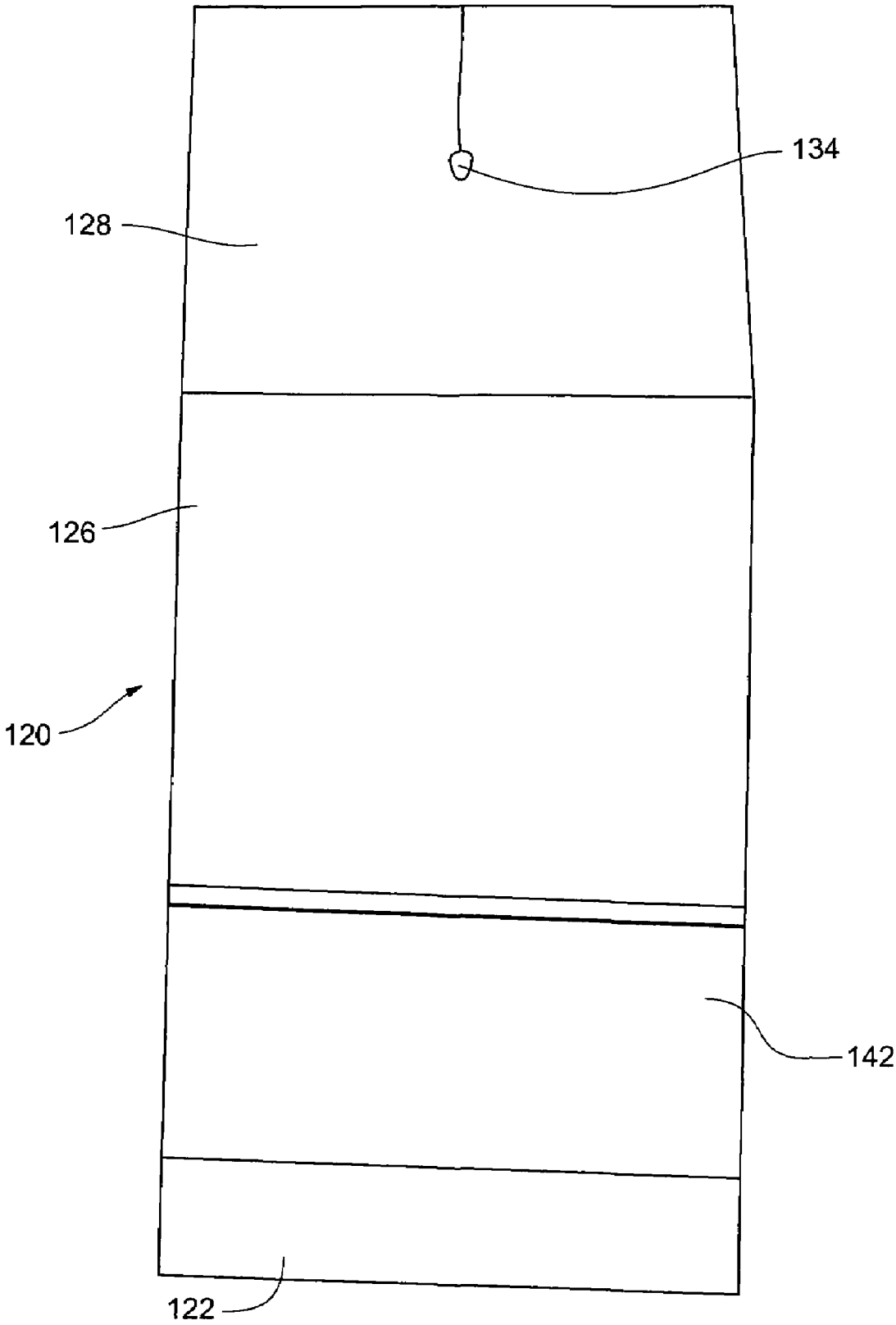
FIG. 5 is a front view of a vertical panel assembly of the present invention.
Figure 6:
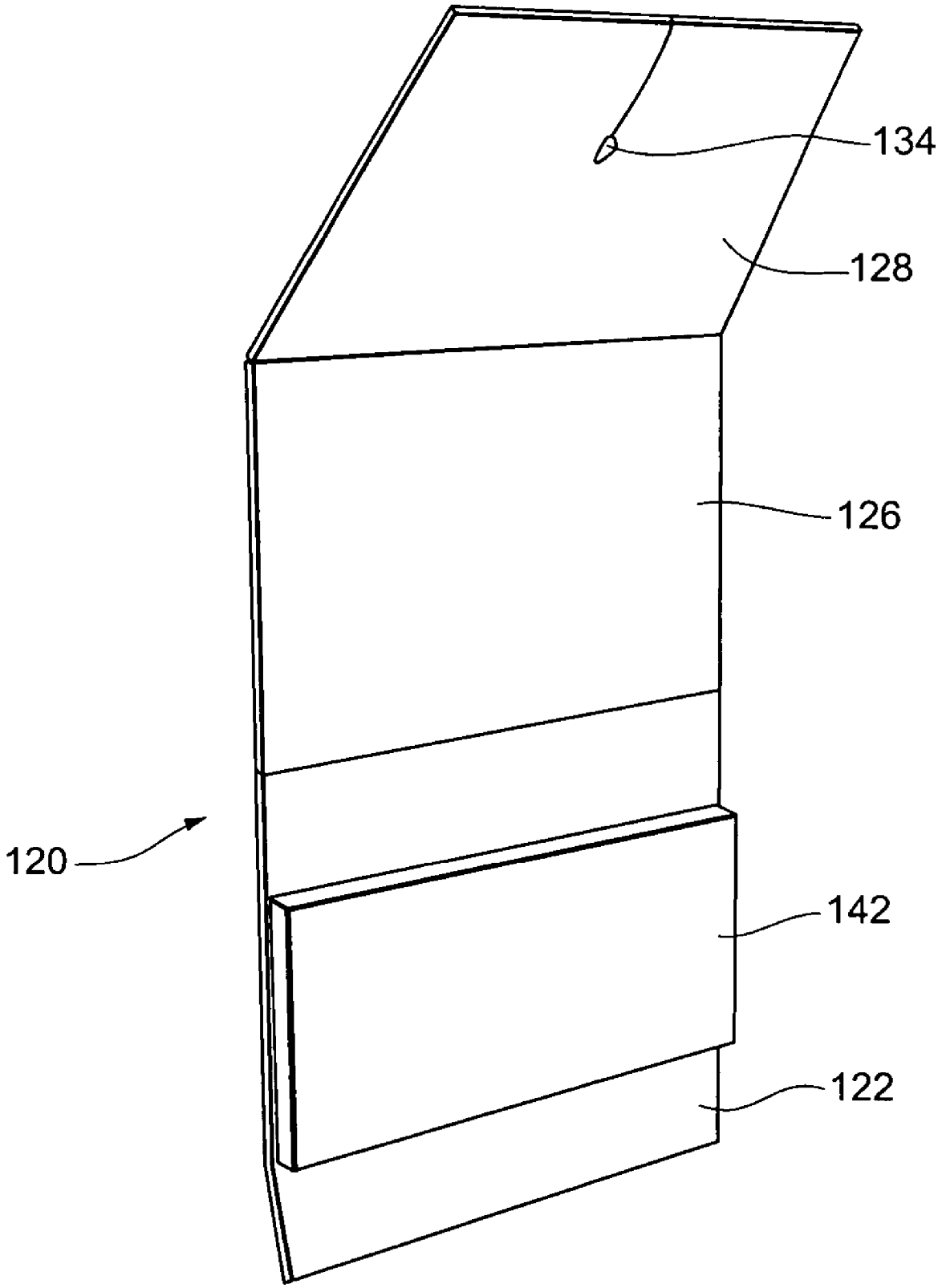
FIG. 6 is a perspective, front view of the vertical panel assembly of FIG. 5.

As shown in FIG. 4, a portable acoustic shell system 100 of the present invention comprises a remote electronic acoustical assembly 102 integrally wired to a portable acoustic shell 104. Through the combination of electronic acoustical assembly 102 and portable acoustic shell 104, a performance area 106 can be enveloped with an active sound field. Using electronic acoustical assembly 102, the active sound field can be tuned or adjusted to provide a desired acoustic sound. The size and shape of performance area 106 can be varied by changing the orientation or number of vertical panel assemblies 120 that make up portable acoustic shell 104.

Figure 7:
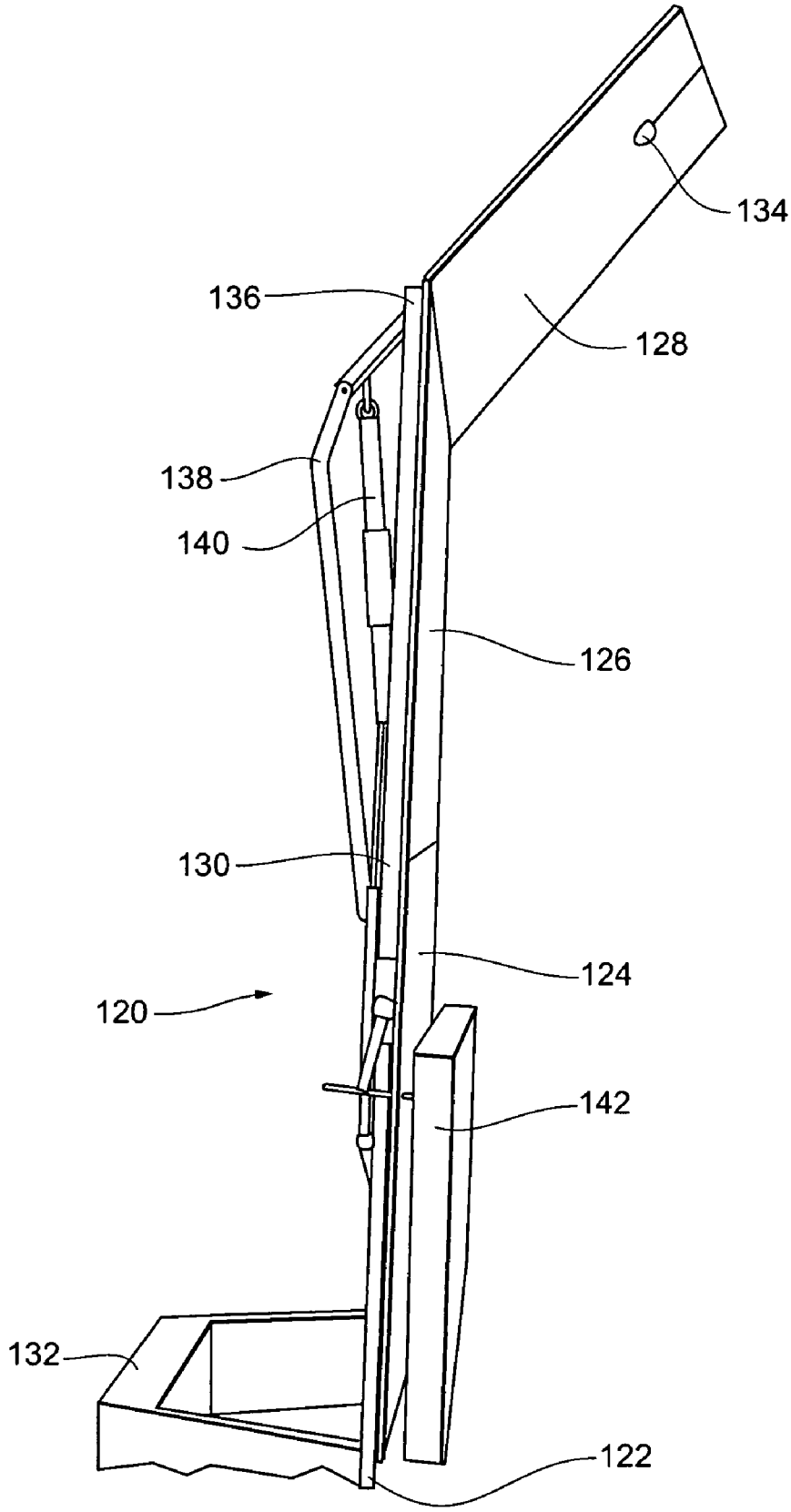
FIG. 7 is a side view of the vertical panel assembly of FIG. 5.
Figure 8:
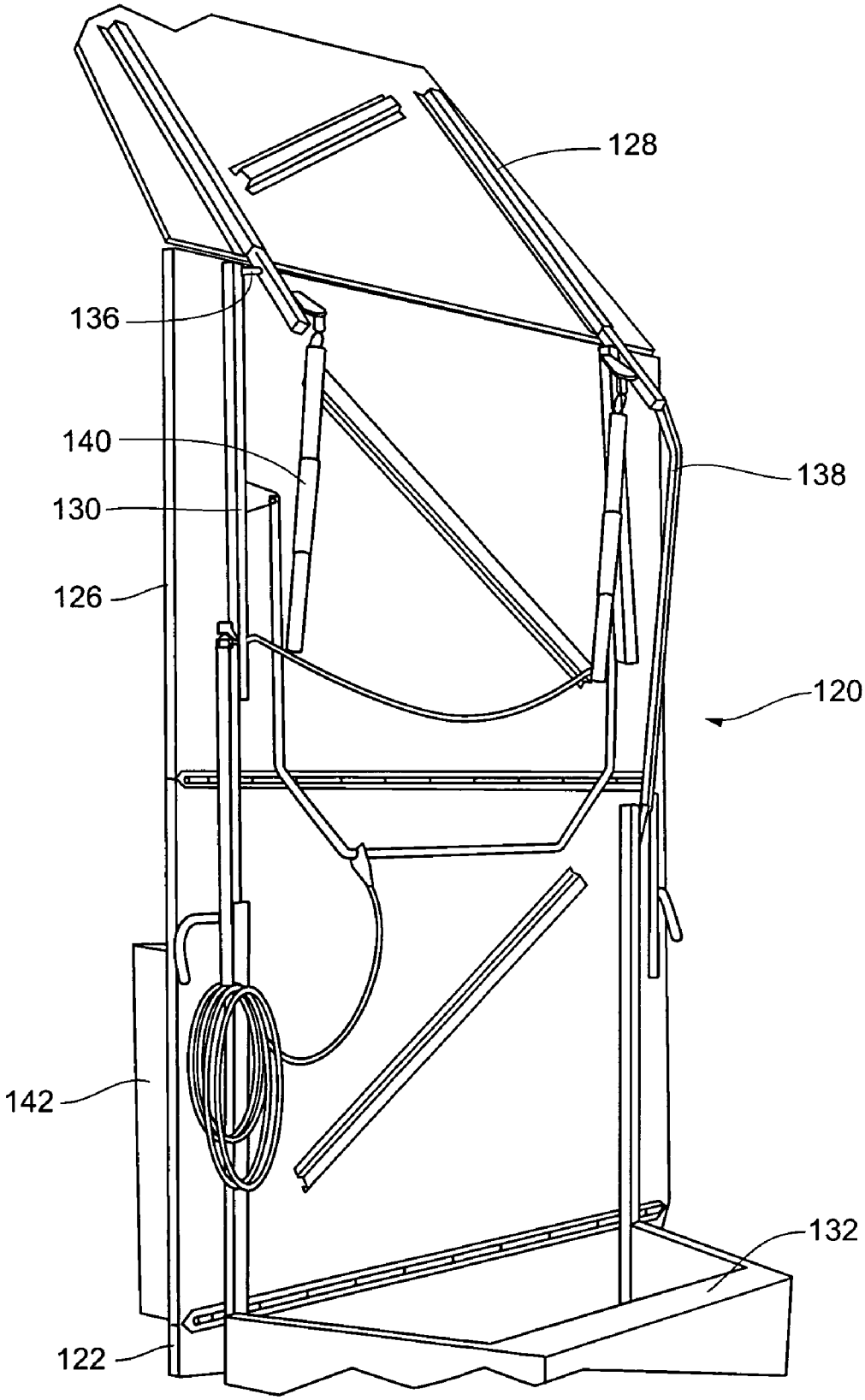
FIG. 8 is a perspective, rear view of the vertical panel assembly of FIG. 5.

A vertical panel assembly 120 of the present invention is further depicted in FIGS. 5, 6, 7 and 8. Generally, vertical panel assembly 120 comprises a plurality of panel sections; for example, a kicker panel 122; a lower panel 124; a top panel 126; and a canopy panel 128, mounted to a vertical frame 130, which is fixedly attached to a base assembly 132. Hanging from canopy panel 128 is a microphone assembly 134. As shown in FIG. 7, a hinge assembly 136 is mounted between top panel 126 and canopy panel 128 to provide rotational movement of the canopy panel 128 in relation to the top panel 126. Hinge assembly 136 can include a biasing arm 138 and a spring assist 140 to allow for easier manipulation of canopy panel 128.

Figure 9:
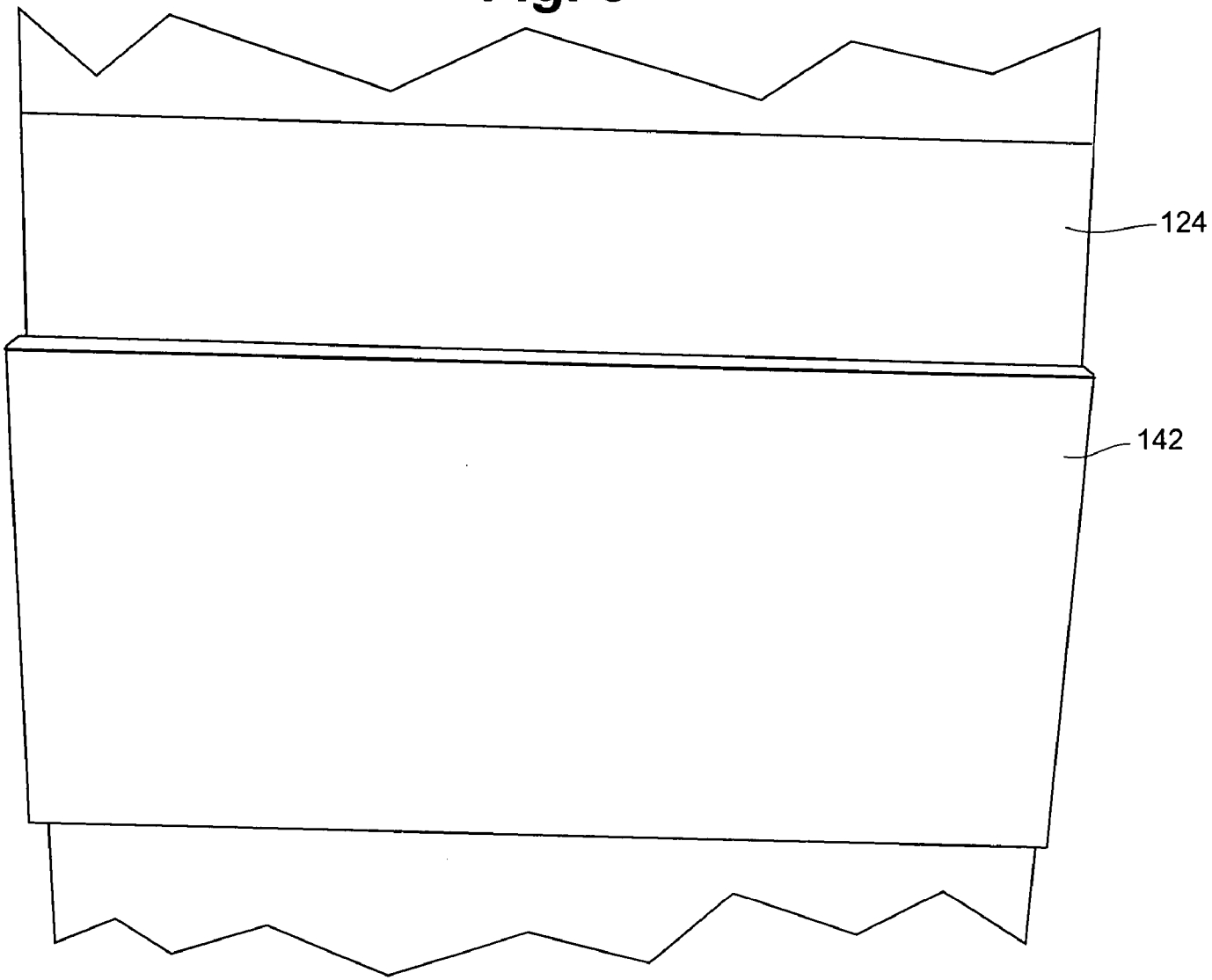
FIG. 9 is a front view of an absorber panel of the present invention.
Figure 10:
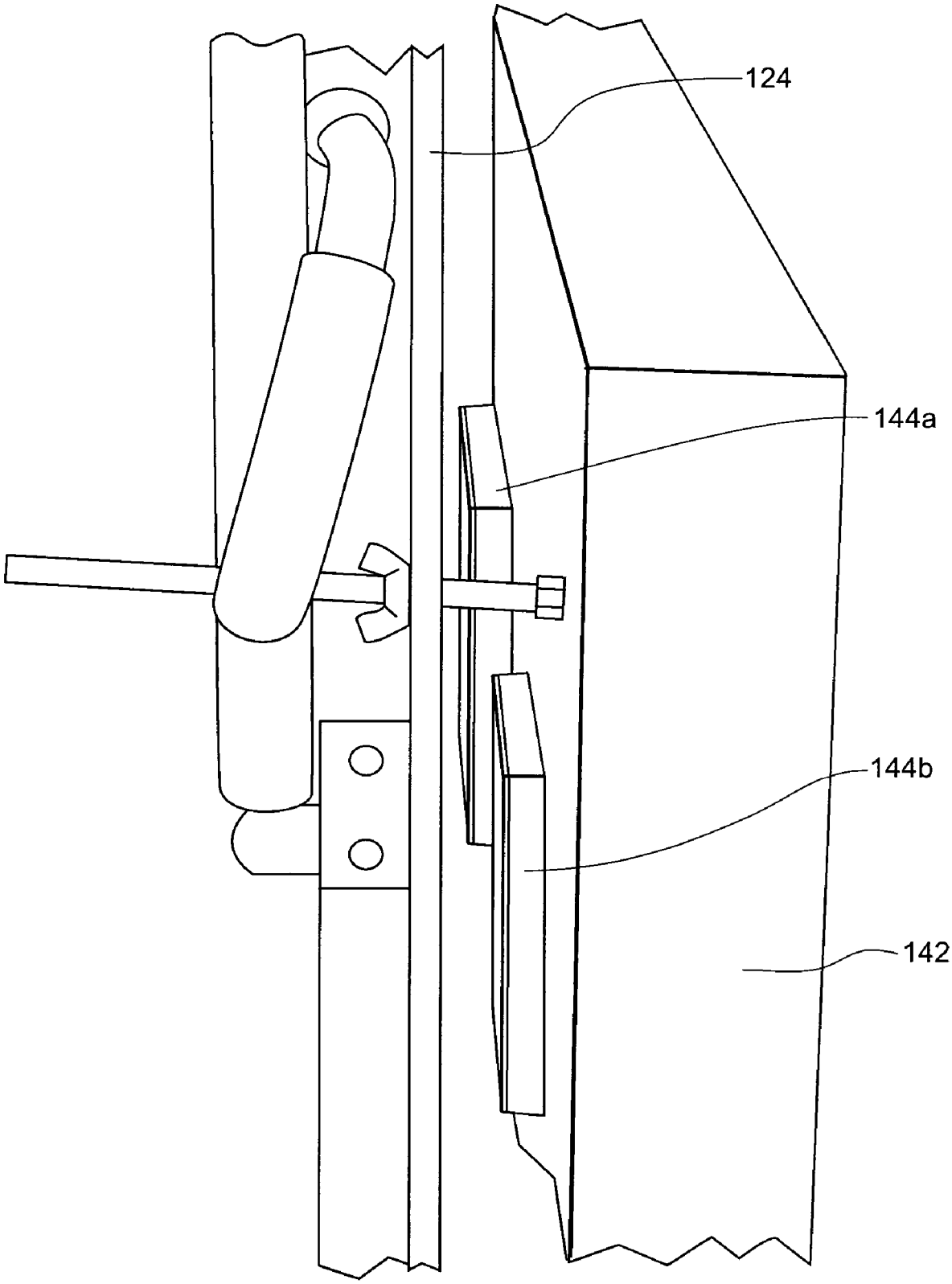
FIG. 10 is a side view of the absorber panel of FIG. 9.
Figure 11:
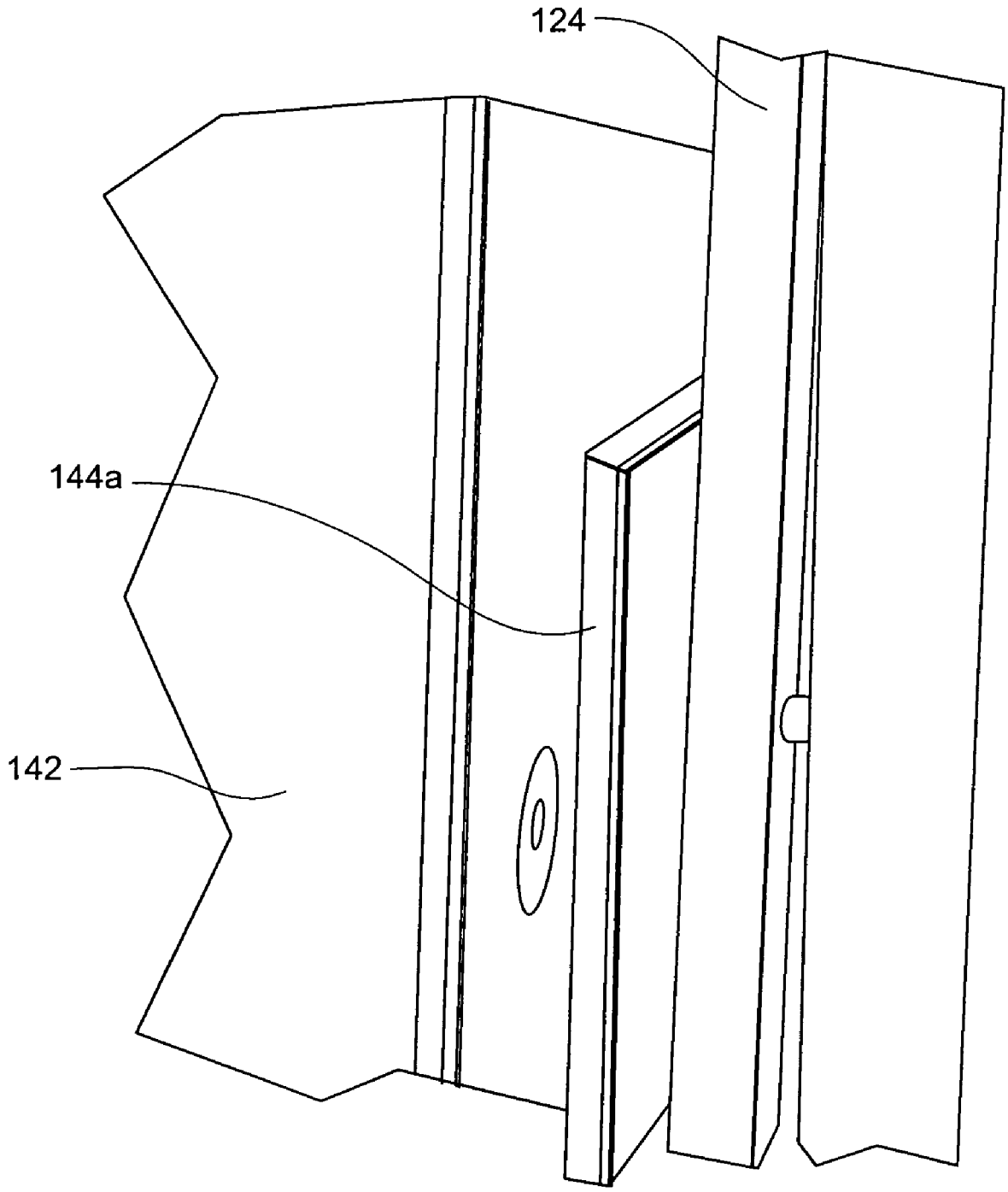
FIG. 11 is a side view of the absorber panel of FIG. 9.

Absorber panel 142 is depicted in FIG. 9. As shown in FIGS. 10 and 11, absorber panel 142 typically includes a pair of speaker assemblies 144*a*, 144*b* oriented to face the reflective surface of the vertical panel assembly 120. In an alternative embodiment, a separating element may be provided between speaker assemblies 144*a*, 144*b*.

Canopy panel 128 and vertical panel assembly 120 define an acoustic reflective zone in the performance area 106. Sounds made by a performer in the acoustic reflective zone are received by microphone assembly 134. Absorber panel 142 defines an anechoic zone within the performance area 106. Speaker assemblies 144*a*, 144*b* are oriented toward vertical panel assembly 120 so that the sound they produce will reach a performer in the performance area indirectly.

Figure 12:
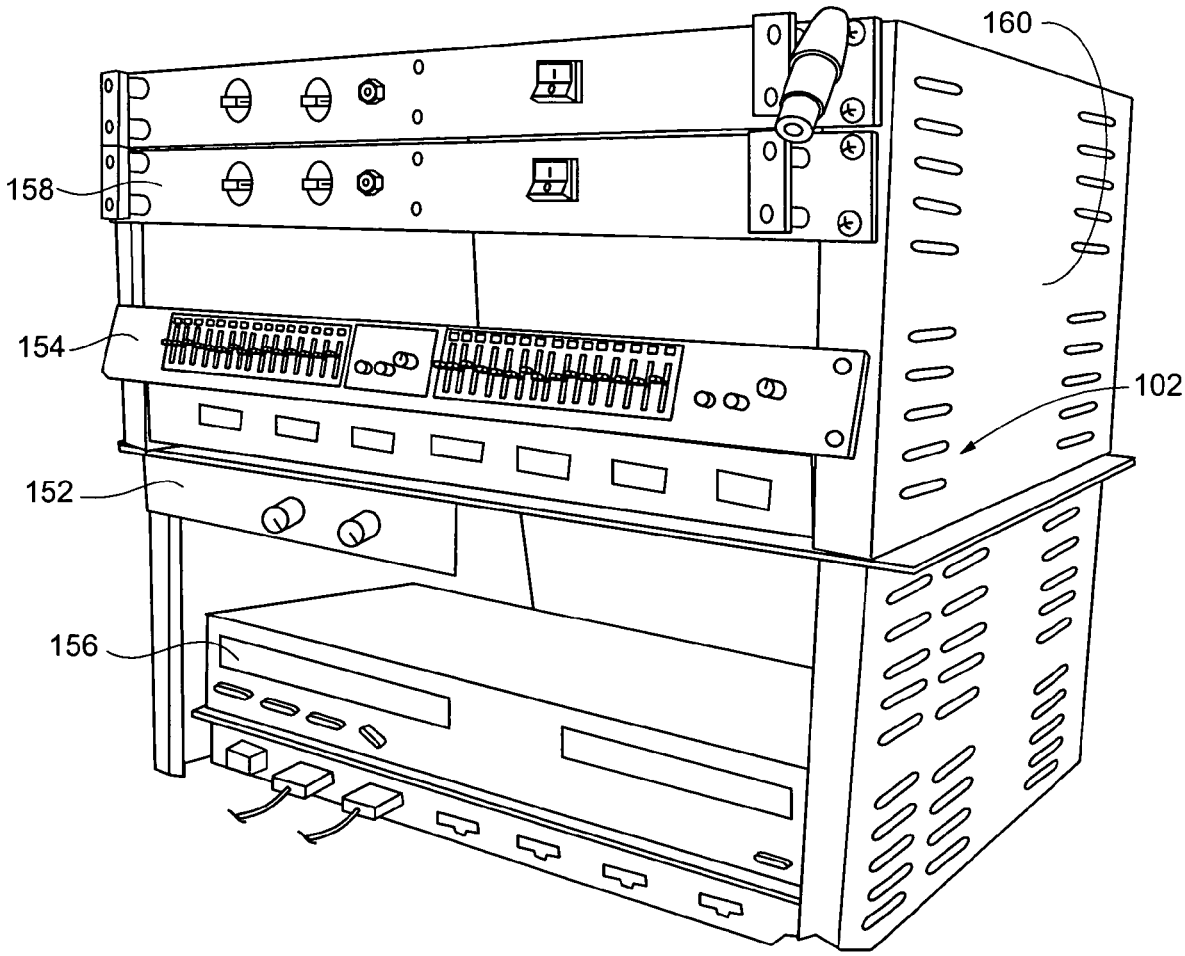
FIG. 12 is a perspective view of an electronic acoustic system of the present invention.

The electronic acoustic system 102 is depicted in FIG. 12. Generally, electronic acoustic system 102 comprises a microphone preamplifier 152 having a minimum of two channels, an equalizer 154 having a minimum of two channels, a digital signal processor 156 with a minimum of four channels of processing, and an audio amplifier 158 having a minimum of one channel for each channel of the digital signal processor 156. The components of electronic acoustic system 102 are generally mounted in a frame assembly 160 to provide convenient wiring and operation of the components. Frame assembly 160 can include a plurality of casters to provide for easy transport and positioning of electronic acoustic system 102. In an alternative embodiment, electronic acoustic system 102 can be located in an enclosure suitable for attachment directly to a vertical panel assembly 120. In a preferred embodiment, the digital signal processor 156 includes LARES (Lexicon Acoustic Reinforcement and Enhancement System) Digital Signal Processing Technology as manufactured by Lares Associates, Inc., Columbia, Md. Preferably, the components have specifications as described in Table A. However, it should be noted that different and/or additional components with different and/or additional specifications may be used without departing from the spirit or scope of the invention.

TABLE A

Component Specifications

| Component Number | Component Name | Specifications |
|---|---|---|
| 134 | Microphone Assembly | Transducer Type: self-polarized condenser microphone<br>Frequency Response: 60 to 20,000 Hz<br>Signal-to-Noise Ratio re 1 Pa (A-Weighted): 67 dB<br>Maximum sound pressure level for 1.0% THD: 115 dB SPL |
| 144a, 144b | Speaker Assembly | Frequency Response:<br>On Axis (0°) +/− 2 dB from 70-20 kHz<br>Off Axis (30°) +/− 2 dB from 70-15 kHz<br>Sensitivity-room/Anechoic; 89 dB/86 dB<br>Maximum input power: 80 watts<br>Low frequency extension: 48 Hz (DIN) |
| 152 | Microphone Preamplifier | Input Impedance: Greater than 3k ohms<br>Frequency Response: 20-20 kHz, +0, −1 dB |

TABLE A-continued

Component Specifications

| Component Number | Component Name | Specifications |
|---|---|---|
| | | THD: [0.01% (1 kHz, +24 dBm Gain, 600 ohms, balanced out) Maximum gain 66 dB, Minimum gain 26 dB UL ®-Listed |
| 154 | Equalizer | Frequency Bands: ⅔ - Octave ISO Spacing from 25 Hz to 16 kHz Type: Constant Q Accuracy: 3% center frequency Frequency response: 20-60 kHz; +0/−3 dB THD + Noise: .009%; +/−.002%; +4 dBu, 20-20 kHz IM Distortion (SMPTE): .005%, +/−.003%; 60 Hz/7 kHz, 4:1, +4 dBu, 20 kHz bandwidth Signal-to-Noise: 108/92 dB +/− 2 dB; re +20 dBu/+4 dBu; Slider Centered, Unity gain UL ®-Listed and CSA-approved |
| 156 | Digital Signal Processor | Frequency response: Unprocessed Channels 10 Hz-100 kHz, +1 dB, −3 dB, Ref. 1 kHz Processed Channels 10-18 kHz, +1 dB, −3 dB, Ref. 1 kHz THD + Noise: <0.05% @ 1 kHz maximum level Signal-to-Noise ratio: 90 dB min., A-weighted, Ref. 1 kHz level UL ®-Listed, CSA-approved |
| 158 | Audio Amplifier | Output power: 45 watt @ 4 ohms, 20-20 kHz, 0.1% THD Frequency Response: 20-20 kHz, +0, −1 dB at 1 watt Slew rate: 6 V/us Damping factor: Greater than 400 from DC to 400 Hz Signal-to-Noise: 106 dB from 20 Hz to 20 kHz @ 45 W Total Harmonic Distortion (THD): >0.001% @ 45 W from 20 Hz to 400 Hz increasing linearly to 0.03% at 20 kHz UL ®-Listed, CSA-approved |

Generally, the portable acoustic shell system 100 of the present invention is used by first assembling the portable acoustic shell 104. Based on the desired shape and size of portable acoustic shell 104, the appropriate number of vertical panel assemblies 120 are positioned in a side-by-side arrangement. Typically, each vertical frame 130 will include a combination attachment/locking mechanism allowing adjacent vertical panel assemblies 120 to be interconnected and locked into position. Once the portable acoustic shell 104 is assembled, the electronic acoustical assembly 102 is wired to the portable acoustic shell 104 such that the electronic acoustical assembly 102 is in electrical communication with the microphone assembly 134 and the speaker assemblies 144*a*, 144*b*. For purposes of assembling the portable acoustic shell system 100, the location of electronic acoustical assembly 102 in comparison to the portable acoustic shell 104 is unimportant. Generally, the only requirement for positioning the electronic acoustical assembly 102 is that it be in an electrically safe environment and that a power supply is readily available.

Figure 13:
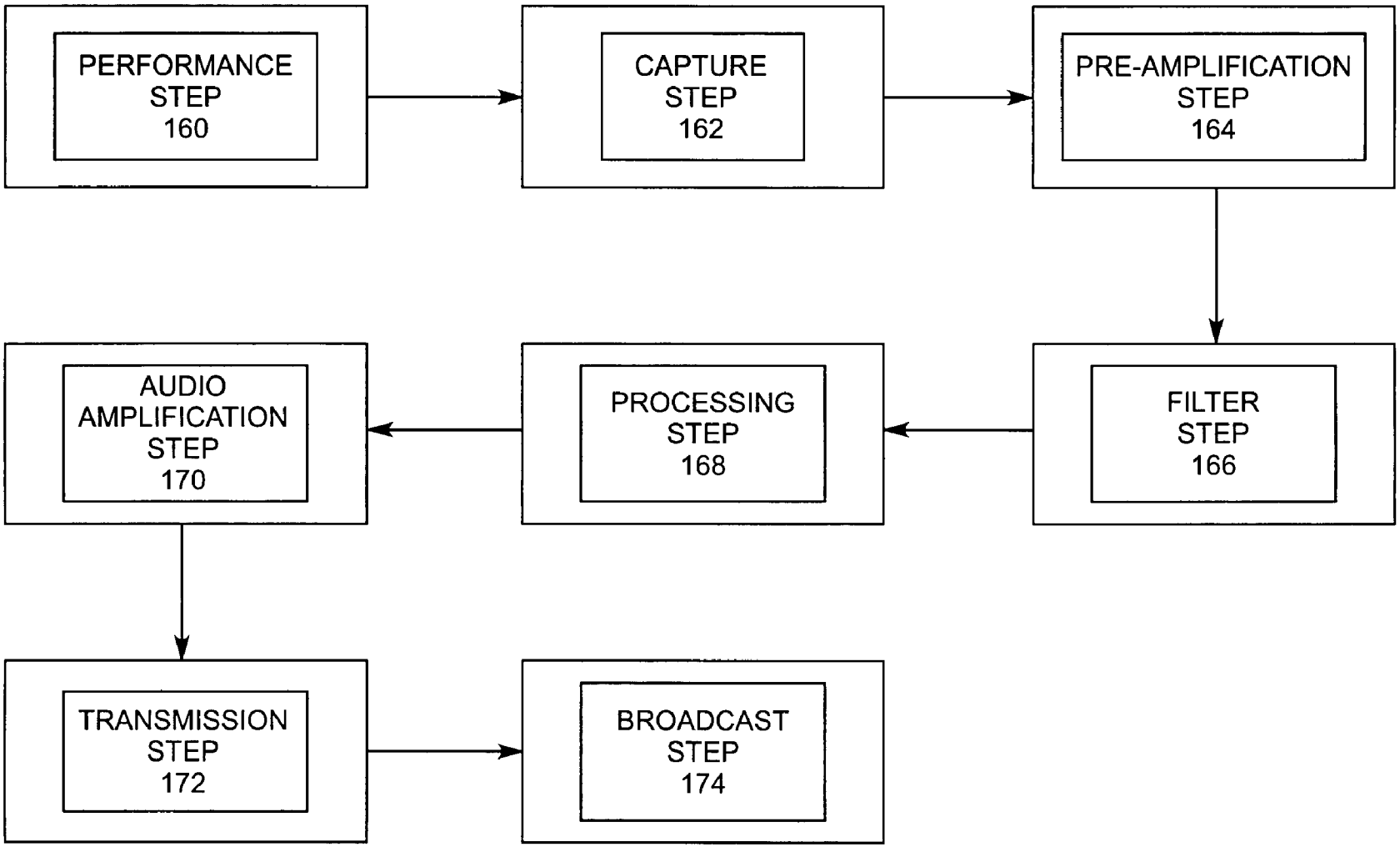
FIG. 13 is a flow chart depicting a method of creating an active sound field encompassing a performance area in a portable acoustic shell of the present invention.

Use of the portable acoustic shell system 100 during a performance is described with reference to FIG. 13. Once the portable acoustic shell system 100 is assembled, a performance step 160 can commence. Performance step 160 can include any type of performance that includes an audio portion such as speeches, concerts, plays and other forms of performances. Once performance step 160 has begun, a capture step 162 is initiated, whereby the microphone assemblies 134 capture the audio portion of the performance step 160. Depending upon the size and configuration of the portable acoustic shell 104, a plurality of microphone assemblies 134 can be used to ensure complete and accurate capture of the audio portions. Once the microphone assembly 134 captures the audio portions, the captured audio signal is amplified by the microphone preamplifier 152 in a preamplification step 164. The amplified signal is then filtered through the equalizer 154 in a filter step 166. The filtered signal is then processed by the digital signal processor 156 in a processing step 168. In processing step 168, the filtered signal is tuned and adjusted according to the desired audio characteristics that have been input by a user. By changing these desired audio characteristics within digital signal processor 156, a user can selectively process, modify and/or enhance the filtered signal. The desired audio characteristics can be modified at any time, including between performances, or "on the fly" during an actual performance. The digital signal processor 156 processes the signal into four outputs, which are fed to the audio amplifier 158 in an audio amplification step 170. Audio amplification step 170 amplifies the four outputs to create four channels of audio amplified signals. The four channels of audio amplified signals are then fed to the speaker assemblies 144*a*, 144*b* in a transmission step 172. In transmission step 172, the audio amplified signals are fed to speaker assemblies 144*a*, 144*b* in an interleaving pattern, such that adjacent speakers are never on the same audio/processing channel. Finally, the speaker assemblies 144*a*, 144*b* reflect/diffuse the audio amplified signals back to the musicians/audience in a broadcast step 174.

Canopy panel 128 and vertical panel assembly 120 define an acoustic reflective zone in performance area 106. Sounds made by a performer in the acoustic reflective zone are received by microphone assembly 134. This sound is processed by electronic acoustic system 102 and returned to the performer by way of speaker assemblies 144*a*, 144*b*. Absorber panel 142 is mounted between the speaker assemblies 144*a*, 144*b* and performance area 106 so that absorber panel 142 provides a semi-anechoic zone within the reflective zone described above. Speaker assemblies 144*a*, 144*b* are oriented away from performance area 106 and toward vertical panel assembly 120 and the sound they produce reaches a performer in the performance area indirectly. This configuration and the creation of a semi-anechoic zone between speaker assemblies 144*a*, 144*b* by way of absorber panel 142, provides acoustic feedback to a performer in performance area 106 that can be optimized to a particular piece or ensemble, and which is reproducible at different set up sites. Accordingly, a performer practicing in one space, and performing in a different space, will not have to adapt "on the fly" to the varying acoustics of different performance spaces.

Although various embodiments of the present invention have been disclosed here for purposes of illustration, it should be understood that a variety of changes, modifications and substitutions may be incorporated without departing from either the spirit or scope of the present invention. For example, the vertical panel assemblies can include additional speaker assemblies, for example, in canopy panel 128, to further enhance the performance of the portable acoustic shell system 100 of the present invention. In other embodiments, microphone assemblies 134 can be positioned in alternative locations, such as in front of the portable acoustic shell 104, within the performance area 106 or even being handheld by the performers themselves.

What is claimed is:

1. An acoustic shell system for enhancing sound made by a performer in a performance area, the acoustic shell system comprising:

a microphone positioned in the performance area to receive sound made by the performer;

a first panel having an acoustic reflective surface oriented toward the performance area;

a second panel spaced apart from the first panel, the second panel having an acoustic reflective surface oriented toward the first panel and an acoustic absorptive surface oriented toward the performance area to create a semi-anechoic zone within the performance area proximal the acoustic absorptive surface;

an electronic acoustic assembly operably coupled to the microphone for processing sound received by the microphone; and a speaker operably coupled to the electronic acoustic assembly, positioned intermediate the first panel and the second panel, and oriented toward the acoustic reflective surface of the first panel to broadcast sound processed by the electronic acoustic assembly indirectly to the performance area.

2. The acoustic shell system of claim 1, further comprising:

a third panel angularly from the first panel toward the performance area; and a biasing hinge assembly operably coupling the first panel to the third panel.

3. The acoustic shell system of claim 1, further comprising a fourth panel having an acoustic reflective surface oriented toward the performance area, the fourth panel being operably coupled to the first panel with a locking mechanism.

4. The acoustic shell system of claim 1, wherein the electronic acoustic assembly is adapted to process the sound received by the microphone such that the sound broadcast by the speaker has customizable audio characteristics.

5. The acoustic shell system of claim 1, further comprising a second speaker operably coupled to the electronic acoustic assembly, positioned intermediate the first panel and the second panel, and oriented toward the acoustic reflective surface of the first panel to broadcast the sound processed by the electronic acoustic assembly indirectly to the performance area.

6. The acoustic shell system of claim 5, wherein the electronic acoustic assembly is adapted to transmit first and second amplified signals to the respective speakers on different channels.

7. A method of enhancing sound made by a performer in a performance area of an acoustic shell system, the acoustic shell system including a microphone, a speaker positioned intermediate first and second spaced-apart panels and oriented toward the first panel, and an electronic acoustic assembly operably coupled to the microphone and the speaker, the method comprising:

creating a semi-anechoic zone within the performance area proximal the second panel;

receiving, with the microphone, sound made by the performer;

processing, with the electronic acoustic assembly, sound received by the microphone; and broadcasting, from the speaker indirectly to the performance area, sound processed by the electronic acoustic assembly.

8. The method of claim 7, further comprising:

altering a signal corresponding to the sound received by the microphone with a preamplifier;

filtering the signal with a filter; and processing the signal with a digital signal processor.

9. The method of claim 7, wherein the first panel has an acoustic reflective surface oriented toward the performance area, the method further comprising reflecting, off of the acoustic reflective surface of the first panel, the sound broadcast by the speaker.

10. the method of claim 9, wherein the second panel has an acoustic reflective surface oriented toward the first panel, the method further comprising reflecting, off of the acoustic reflective surface of the second panel, the sound reflected by the acoustic reflective surface of the first panel.

11. The method of claim 10, further comprising re-reflecting, off of the acoustic reflective surface of the first panel, the sound reflection by the acoustic reflective surface of the second panel.

12. The method of claim 7, wherein the second panel has an acoustic absorptive surface oriented toward the performance area, the method of creating, with the acoustic reflective surface, a semi-anechoic zone comprising absorbing the sound made by the performer.

13. The method of claim 7, further comprising providing acoustic feedback to the performance area.

14. The method of claim 7, wherein the acoustic shell system further comprises a second speaker positioned intermediate the first and second spaced-apart panels and oriented toward the first panel, the step of processing the sound further comprising transmitting audio amplified signals to the speakers on different channels.

15. The method of claim 7, further comprising altering, with a preamplifier, a signal corresponding to the sound received by the microphone.

16. The method of claim 7, further comprising filtering, with a filter, a signal corresponding to the sound received by the microphone.

17. The method of claim 7, further comprising processing, with a digital signal processor, a signal corresponding to the sound received by the microphone.

18. The method of claim 7, further comprising amplifying, with an audio amplifier, a signal corresponding to the sound received by the microphone.

19. An acoustic shell system for enhancing sound made by a performer in a performance area, the acoustic shell system comprising:

a microphone positioned in the performance area to receive sound made by the performer;

a first panel having a first acoustic reflective surface oriented toward the performance area;

a second panel spaced apart from the first panel, the second panel having a second acoustic reflective surface oriented toward the first acoustic reflective surface and an acoustic absorptive surface oriented toward the performance area, the first acoustic reflective surface and the second acoustic reflective surface being opposed boundaries of a space between the first acoustic reflective surface and the second acoustic reflective surface;

an electronic acoustic assembly operably coupled to the microphone for processing sound received by the microphone; and a speaker operably coupled to the electronic acoustic assembly, located within the space, and positioned to broadcast sound into the space, wherein sound processed by the electronic acoustic assembly is broadcast indirectly to the performance area.

20. The acoustic shell system of claim 1, further comprising a second speaker operably coupled to the electronic acoustic assembly, located within the space, and positioned to broadcast sound into the space, wherein sound processed by the electronic acoustic assembly is broadcast indirectly to the performance area.

* * * * *